United States Patent [19]

Bekkers et al.

[11] Patent Number: 4,555,036

[45] Date of Patent: Nov. 26, 1985

[54] SAFETY CLOSURE

[75] Inventors: Henricus A. M. Bekkers, Mierlo; Tjerk Reyenga, Oostvoorne, both of Netherlands

[73] Assignee: Technoplast B.V., Monster, Netherlands

[21] Appl. No.: 671,944

[22] Filed: Nov. 16, 1984

[30] Foreign Application Priority Data

May 9, 1984 [DE] Fed. Rep. of Germany ..... 3417184

[51] Int. Cl.[4] ..... B65D 55/02

[52] U.S. Cl. ..... 215/220; 215/203

[58] Field of Search ..... 215/219, 220, 203

[56] References Cited

U.S. PATENT DOCUMENTS 3,776,407 12/1973 Cistone ..... 215/220

3,887,099 6/1975 Gillman et al. ..... 215/220

4,446,979 5/1984 Gach et al. ..... 215/220

*Primary Examiner*—George T. Hall

*Attorney, Agent, or Firm*—Fleit, Jacobson, Cohn & Price

[57] ABSTRACT

A safety closure, particularly safe in the hands of children, to safely close containers composed of an assembly of an inner cap and an outer cap, the inner cap provided with threading for screwing onto the mouth of a container. The outer cap can be depressed over the inner cap against a resilient force provided by lips coating with a conical surface. When depressed, teeth on the outer cap mesh with teeth on the inner cap to effect unscrewing of the closure. A ratchet provided by teeth on the inner cap cooperating with tangential protrusions on the outer cap enable onscrewing of the closure but prevent offscrewing.

3 Claims, 6 Drawing Figures

SAFETY CLOSURE

The invention relates to a safety closure, particularly safe in the hands of children, to safely close containers.

BRIEF SUMMARY OF THE INVENTION

The closure comprises an assembled combination of an inner cap housed in and surrounded by an outer cap and whereby the inner cap is provided at its top side with a central closed cylindrical portion and a surrounding external skirt portion which comprises at its inner side a threaded portion which serves to screw the closure upon the mouth of a container. The external skirt portion is connected with said cylindrical portion integrally by means of an intermediate wall portion comprising a conical part. The outer cap is provided with a top wall end portion, having a central opening to cooperate with the closed cylindrical portion of the inner cap. The outer cap also has a cylindrical skirt portion which extends from the edges of the top wall end portion and the outer cap is guided by coacting in a sliding relation with the central closed cylindrical portion of the inner cap. The top wall end portion of the outer cap comprises inwardly extending flexible lips which point inwardly in the space created between the central closed cylindrical portion of the inner cap and the intermediate wall portion of the inner cap. The lips cooperate with the conical portion of the intermediate wall portion in such manner that when the outer cap of the closure is not being pressed down, the upper part of the central closed cylindrical portion on the inner cap and the top end wall portion of the outer cap, substantially lie in the same plane by virtue of the resilient interaction between the lips and the conical portion. When a downward pressure is exerted on the outer cap, the outer cap slides relative to the inner cap being guided by the coaction between the central closed cylindrical portion and the outer cap. During this time the lips engage and are guided along the conically shaped intermediate wall portion on the inner cap. The external skirt portion of the inner cap is provided with radial rib-shaped teeth which engage with radial rib-like teeth formed on the cylindrical skirt portion of the outer cap when the outer cap has slid axially relative to the inner cap by a predetermined distance. The surface of the intermediate wall portion on the inner cap which is facing the central closed cylindrical portion is provided with radial rib-shaped teeth, whereas each of the inwardly protruding lips on the outer cap is provided with a tangentially extending protrusion having a length in the axial direction which is less than the length of said lips, but of such length that these protrusions interengage the rib-like teeth on the inner cap both when no pressure is exerted upon the outer cap of the closure and when pressure is exerted on the outer cap and it has moved axially relative to the inner cap to its full extent; that is, to the point the first mentioned radial rib-shaped teeth are engaged.

BACKGROUND OF THE INVENTION

From a prior development a safety closure is known, published Nov. 25, 1982 in the international patent application No. PCT/EP82/00100, which has the feature of an interengagement effected between radial rib-shaped teeth on the inner surface of the skirt portion of the outer cap with radial rib-shaped teeth provided on the outer surface of the skirt portion of the inner cap and whereby exerting a downward pressure upon the outer cap and against spring operation of lips engaged with a conical surface and by a simultaneously effected rotational movement of the outer cap, a co-rotation of the inner cap is caused which enables onscrewing or unscrewing of the safety closure.

A disadvantage for onscrewing of this prior closure upon a container mouth is the requirment to press down the outer cap for interengaging the inner and outer caps before rotation of the outer cap can be transmitted to the inner cap. The user must thus be informed of the instruction "press down" (for onscrewing) and he must repeatedly keep in his mind while onscrewing the closure to press it down initially and to maintain it pressed down.

It is the object of the invention to improve the prior closure as described before in such a manner as to avoid the necessity of providing instructions for onscrewing and to enable the user to easily onscrew without any special instructions or considerations.

According to the present improvement and invention a safety closure of the aforementioned type is especially constructed and characterized in that the surface of the intermediate wall portion on the inner cap which is facing the cylindrical portion is peripherally spaced, provided with radial rib-shaped teeth whereas each of the inwardly protruding circumferentially spaced lips on the outer cap is provided on its surface facing the intermediate wall portion with a tangentially extending protrusion having a length in the axial direction which is less than the length of said lips, but great enough for these protrusions to interengage the radial, rib-shaped teeth on the inner cap in all relative positions of the two caps. That is, whether pressure is being exerted upon the outer cap of the closure or not.

By this novel invented safety closure, the provision of the described additional teeth creates an interengagement even at no downward pressure on the outer cap and this ensures a more powerful cooperation between the inner and outer caps.

DESCRIPTION OF THE DRAWINGS

Hereinafter, the invention is further elucidated by means of a preferred embodiment which is illustrated in the drawings in which.

DETAILED DESCRIPTION

Figure 1:
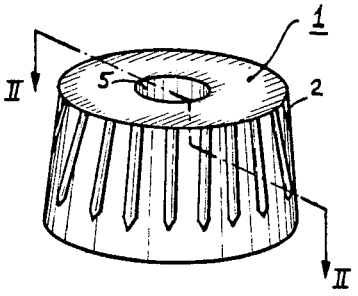
FIG. 1 is a perspective view of an invented safety closure.
Figure 2:
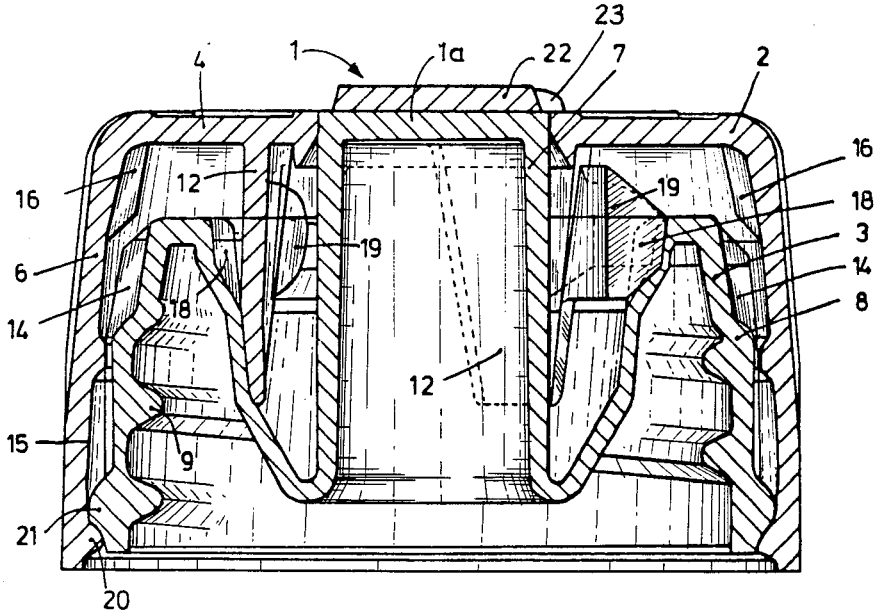
FIG. 2 is a cross-section according to II—II of FIG. 1, showing the safety closure in a condition when no downward pressure is being exerted upon the outer cap.
Figure 3:
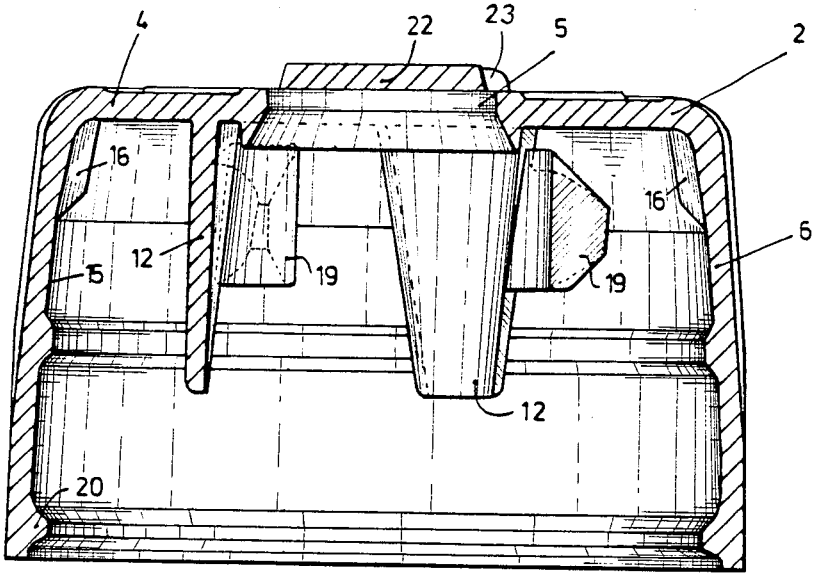
FIG. 3 is a cross-section of the outer cap of the novel and improved closure.
Figure 4:
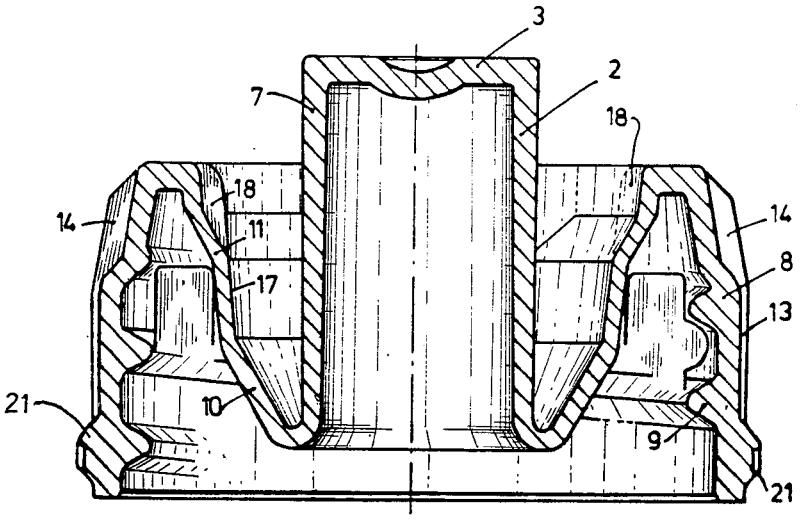
FIG. 4 is a cross-section of the inner cap according to the invention.
Figure 5:
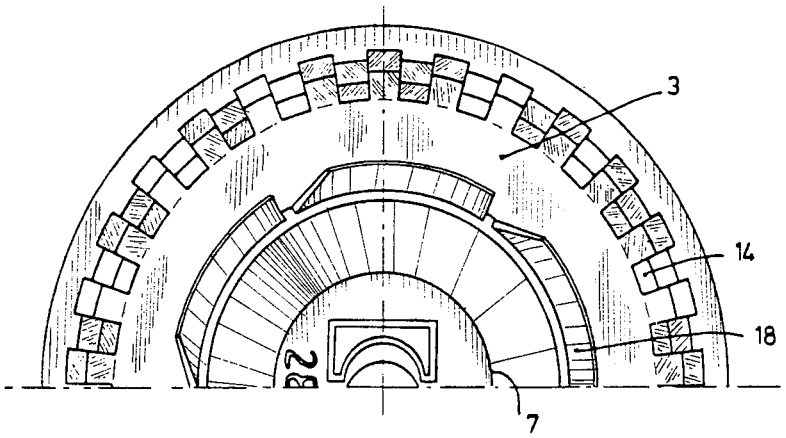
FIG. 5 is a top view of one-half of the inner cap according to FIG. 4.
Figure 6:
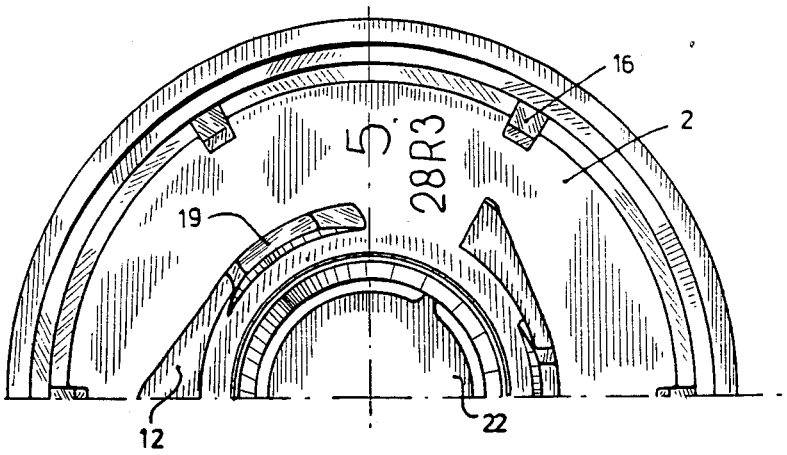
FIG. 6 is a bottom view of one-half of the outer cap in FIG. 3.

From the figures of the drawing, the safety closure generally designated by reference numeral 1 in FIG. 1 and FIG. 2 comprises combined outer cap 2 and inner cap 3 loosely assembled as will be explained in detail hereinafter. The inner cap 3 and outer cap 2 are molded from suitable, safe for human use, plastic materials, in a manner known in the art. The outer cap 2 is provided with a top end wall portion 4 in which a central opening 5 is located. A cylindrical skirt portion 6 depends from the outer peripheral edge of the end wall portion 4.

The inner cap 3 comprises a central cylindrical portion 7, closed at its top 7a, and an external skirt portion 8, which is provided with integrally molded screw threads 9 to enable the closure to be mounted onto the mouth of a container having complementary screw threads, all as well known in the art. The external skirt portion 8 is integrally connected, by means of an intermediate wall portion 11 including a conical portion 10, with the cylindrical portion 7. The wall forming the opening 5 in top end wall portion 4 of outer cap 2 engages and is guided by the cylindrical portion 7 on the inner cap 3, when the outer cap 2 is pressed downwardly relative to inner cap 3.

The end wall portion 4 of the outer cap 2 is provided with inwardly extending resilient or springy lips 12, at least two and preferably not more than four, which point or depend into the space created between the cylindrical portion 7 and the intermediate wall portion 11 of the inner cap 3. The lips 12 coact with and cooperate with the inner surface of conical portion 10 of this intermediate wall portion 11 in such a manner that in the unstressed or repose condition of the safety closure 1 (no downward pressure on outer cap 2), the top side 7a of the cylindrical portion 7 on the inner cap 3 and the top end wall portion 4 of the outer cap 2 are kept or held in substantially the same plane by the bias or spring operation or interaction of the lips 12 against the conical portion 10. In case a pressing force is effected upon the outer cap 2, these lips 12 are guided along the conical portion 10 of the intermediate wall portion 11 on the inner cap 3 and are flexed inwardly increasing the bias to restore the outer cap 2 to the condition shown in FIG. 2, to which cap 2 will return when the pressing force is released.

The outer surface 13 of skirt portion 8 of the inner cap 3 is provided with peripherally spaced, radial rib-like teeth 14, pointing substantially radially, which cooperate and interengage, respectively, with peripherally spaced, radial rib-like teeth 16 formed on the inner surfaces of cylindrical skirt portion 6 and end wall portion 4. Teeth 14 and 16 will engage when outer cap 2 has slid axially downwardly a predetermined distance relative to inner cap 3. This occurs against the bias or pressing force exerted upwardly upon the outer cap 2 by the spring or resilient force of the lips 12 as they are deflected due to following the conical portion 10.

The surface 17 of the intermediate wall 11 which faces inwardly toward the cylindrical portion 7 is provided at its upper end with radially extending, peripherally spaced, rib-like teeth 18. The lips 12 on the outer cap 2 are each provided with a tangential protrusion 19, having a length in the axial direction less than the axial length of the lips 12. These protrusions 19 are curved into the region or plane of teeth 18 and are interengaging with the teeth 18 both in the condition shown in FIG. 2 and when downward pressure is exerted upon outer cap 2 of the closure to effect interengagement of teeth 14 and 16. The combined closure can thus be onscrewed upon a container mouth by the protrusions 19 of the lips 12 which provide a sufficient rigidity in a tangential direction to interengage with teeth 18. In the direction reverse to onscrewing, namely, the offscrewing direction, the protrusions 19 provide sufficient flexibility that upon turning of the outer cap 2 in this reverse direction, the protrusions 19 slide past the teeth 18, due to their flexibility, thereby causing a rattling noise, informing the user by an audible signal to initiate some activity for unscrewing the closure. The teeth 18 and protrusions 19 have the effect of a ratchet, allowing onscrewing but preventing offscrewing except when outer cap 2 is pushed down. The user must achieve offscrewing by pressing down the outer cap 2, thereby causing interengageent of the teeth 16 of the outer cap 2 with the teeth 14 of the inner cap 3 after which the closure can be unscrewed and removed from the mouth of the container.

For loosely keeping the outer and inner caps assembled, the outer cap is provided at its open bottom with a rim 20 extending radially and which overlaps an outer rim 21 provided on the inner cap. The inner and outer caps are manufactured from material with elastic properties, particularly from plastic material, and accordingly, the inner and outer caps are easily mountable and demountable, respectively, by elastic deformation.

In a preferred embodiment the central opening 5 of the top wall portion 4 of the outer cap 2 is protected, covered or locked by a wall portion 22 which is connected to top wall portion 4 by a tearable or rupturable connection 23. This tearable wall portion 22 can be used as a guarantee seal for guaranteeing the kind, quality and quantity of the container content for newly filled containers. Wall portion 22 needs to be removed to actuate the sliding relationship between inner cap 3 and outer cap 2 to effect opening of the closure.

What is claimed is:

1. In a safety closure, particularly safe in the hands of children to safely close containers, which closure comprises an assembled combination of an inner cap housed in and surrounded by an outer cap and whereby the inner cap is provided at its top side with a closed cylindrical portion and a skirt portion having at its inner side a threaded portion to screw upon the mouth of a container, an intermediate wall portion comprising a conical part integrally interconnecting said skirt portion and said cylindrical portion, the outer cap being provided with a top wall end portion having a central opening and also a cylindrical skirt portion which extends from the edge of the top wall end portion, the outer cap being in sliding engagement with and guided by the cylindrical portion of the inner cap, the top wall end portion of the outer cap further having inwardly extending resilient lips which point into the space created between the cylindrical portion and the intermediate wall portion of the inner cap, said lips cooperating with the conical portion of the intermediate wall portion in such manner that when the closure is in repose the upper part of the cylindrical portion on the inner cap and the top end wall portion of the outer cap lie substantially in the same plane and when a downward pressure is exerted on the outer cap said lips are guided along the conically shaped intermediate wall portion on the inner cap and create a restoring force, the skirt portion of said inner cap being provided with a first set of radial rib shaped teeth, the cylindrical skirt portion of the outer cap being provided with a second set of radial rib shaped teeth, said first and second sets of rib like teeth interengaging only when the outer cap is pressed downwardly a predetermined distance, the improvement comprising a third set of radial rib shaped teeth provided on the surface of the intermediate wall portion of the inner cap facing the cylindrical portion, and tangentially extending protrusions provided on the resilient lips, said third set of teeth and protrusions being constructed and dimensioned axially for interengagement when the outer cap is in repose and when it is pressed down to interengage the first and second sets of teeth.

2. The improvement according to claim 1, wherein the protrusions have sufficient rigidity to engage said third set of teeth and effect onscrewing of the closure, but have sufficient flexibility in a direction reverse to onscrewing the closure so that the protrusions slip past the third set of teeth without transmitting any rotational force thereto.

3. The improvement according to claim 1, further includinhg a closing cover portion rupturably attached to the outer cap covering the central opening in the top of the outer cap which must be removed prior to unscrewing the closure for the first time from the mouth of a container.

* * * * *